US009500101B2

(12) United States Patent
Tsuboi et al.

(10) Patent No.: US 9,500,101 B2
(45) Date of Patent: Nov. 22, 2016

(54) POWER GENERATION APPARATUS INCLUDING LUBRICANT SEPARATION MEMBER

(71) Applicant: Kobe Steel, Ltd., Kobe-shi (JP)

(72) Inventors: Noboru Tsuboi, Kako-gun (JP); Masayoshi Matsumura, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 170 days.

(21) Appl. No.: 14/037,557

(22) Filed: Sep. 26, 2013

(65) Prior Publication Data

US 2014/0159369 A1 Jun. 12, 2014

(30) Foreign Application Priority Data

Dec. 12, 2012 (JP) ..... 2012-271067

(51) Int. Cl.

| | |
|---|---|
| ***F01D 25/18*** | (2006.01) |
| ***F01D 25/22*** | (2006.01) |
| ***F01D 15/10*** | (2006.01) |
| ***F01K 25/06*** | (2006.01) |

(52) U.S. Cl.

CPC ..... *F01D 25/18* (2013.01); *F01D 15/10* (2013.01); *F01K 25/06* (2013.01)

(58) Field of Classification Search

CPC ..... F01D 15/10; F01D 25/18; F01K 25/06
See application file for complete search history.

(56) References Cited

U.S. PATENT DOCUMENTS 3,744,246 A * 7/1973 Doerner ..... 60/685
3,834,166 A * 9/1974 Cupper ..... C10M 3/00 585/10
3,967,450 A * 7/1976 Girardier ..... 60/657
4,050,237 A * 9/1977 Pall ..... B01D 39/1676 55/385.4
2009/0188253 A1 7/2009 Smith et al.
2009/0193770 A1* 8/2009 Holzmann ..... B01D 45/06 55/318

(Continued)

FOREIGN PATENT DOCUMENTS

DE 10 2010 022 408 A1 12/2011
EP 2 514 933 A1 10/2012

(Continued)

OTHER PUBLICATIONS

Extended Search Report issued May 19, 2014 in European Patent Application No. 13186657.6.

*Primary Examiner* — Tulsidas C Patel
*Assistant Examiner* — S. Mikailoff
(74) *Attorney, Agent, or Firm* — Oblon, McClelland, Maier & Neustadt, L.L.P.

(57) ABSTRACT

A power generation apparatus of the present invention includes: a separation member that separates a lubricant from a fluid mixture flowing into an expander casing; an expander rotor that is rotationally driven by an expansion force applied from steam of a working medium from which the lubricant is separated; a power generator rotor that rotates with the rotation of the expander rotor; a first bearing holding portion that accommodates a first bearing supporting a first rotation shaft of the expander rotor; a second bearing holding portion that accommodates a second bearing supporting a second rotation shaft of the expander rotor; and a lubricant supply path which connects a lubricant accumulation position inside the expander casing to both inner spaces of the first bearing holding portion and the second bearing holding portion of which the pressures are lower than the pressure of the lubricant accumulation position inside the expander casing.

6 Claims, 5 Drawing Sheets

(56) References Cited

U.S. PATENT DOCUMENTS

2010/0034684 A1* 2/2010 Ast ..... F01K 21/005 418/84
2011/0252801 A1* 10/2011 Minor ..... C09K 3/30 60/645
2011/0265476 A1* 11/2011 Berger ..... F01K 25/065 60/651
2012/0134866 A1* 5/2012 Tsuboi ..... F04C 14/26 418/201.1
2012/0237382 A1 9/2012 Yoshimura
2012/0312009 A1 12/2012 Smith et al.
2012/0312021 A1* 12/2012 Tsuboi et al. ..... 60/667
2013/0207396 A1* 8/2013 Tsuboi ..... H02K 7/1823 290/52
2013/0263598 A1 10/2013 Almbauer et al.
2014/0075941 A1* 3/2014 Adachi et al. ..... 60/646
2014/0356208 A1* 12/2014 Tsuboi ..... 418/55.4

FOREIGN PATENT DOCUMENTS

EP 2 520 771 A1 11/2012
GB 2 427 002 A 12/2006
JP 60-56104 4/1985
JP 2012-147567 8/2012
WO WO 2011074539 A1 * 6/2011

* cited by examiner

POWER GENERATION APPARATUS INCLUDING LUBRICANT SEPARATION MEMBER

BACKGROUND OF THE INVENTION

1. Field of the Invention

The present invention relates to a power generation apparatus and a power generation system.

2. Description of the Related Art

Hitherto, as a power generation system that recovers power from low-temperature waste heat, a binary-cycle power generation system is known in which a working medium (cooling medium) having a low boiling temperature is evaporated by waste heat, an expander rotor is rotationally driven by steam of the working medium, and a power generator is driven by the rotation of the expander rotor. Japanese Patent Application Laid-Open No. 60-56104 discloses an example of the power generation system.

The power generation system of the related art includes an expander, a power generator, a condenser, a cooling medium supply pump, an evaporator, a separation tank, a lubricant supply pump, and a lubricant heating heat exchanger.

The expander includes a casing and a pair of expander rotors (screw rotors) accommodated in the casing. The steam of the cooling medium produced by the evaporator is suctioned into the casing, and the suctioned steam rotationally drives the pair of expander rotors by the expansion force thereof. In accordance with the rotation of the expander rotor, the power generator connected to the expander rotor is driven to generate power. Further, a lubricant is supplied into the casing so as to lubricate a bearing supporting a rotation shaft of the expander rotor or to seal respective portions inside the casing.

Since the lubricant supplied into the casing is discharged from the inside of the casing along with the steam of the cooling medium having been used to rotationally drive the expander rotor, a fluid mixture formed by mixing the lubricant and the steam of the cooling medium discharged from the inside of the casing is separated into the lubricant and the steam of the cooling medium in the separation tank. The steam of the cooling medium separated by the separation tank is discharged from the separation tank and is cooled and condensed by the condenser so as to become a liquid cooling medium. Then, the liquid cooling medium is sent to the evaporator by the cooling medium supply pump and is heated by the waste heat in the evaporator so as to produce steam of the cooling medium. The steam of the cooling medium produced by the evaporator is supplied into the casing of the expander. In this way, the cooling medium is circulated. Meanwhile, the lubricant which is separated by the separation tank is discharged from the separation tank and is sent to the casing of the expander through the heat exchanger by the lubricant supply pump.

SUMMARY OF THE INVENTION

In the power generation system of the related art, since the separation tank is provided so as to separate the fluid mixture discharged from the casing of the expander into the lubricant and the steam of the cooling medium and the lubricant supply pump is provided so as to return the lubricant separated by the separation tank to the casing of the expander, there are problems in which the configuration becomes complex, the size of the power generation system is increased, and the manufacturing cost increases.

The present invention is made to solve the above-described problems, and it is an object of the present invention to provide a power generation apparatus and a power generation system capable of realizing a simple configuration and a compact size thereof and reducing manufacturing cost thereof.

In order to attain the above-described object, a power generation apparatus according to the present invention includes: a casing into which a fluid mixture formed by mixing a liquid lubricant and steam of a working medium flows; a separator which is provided inside the casing so as to separate the lubricant from the fluid mixture flowing into the casing; an expander rotor which is provided inside the casing and is rotationally driven by an expansion force applied from the steam of the working medium in the fluid mixture from which the lubricant is separated by the separator; a power generator which includes a power generator rotor connected to the expander rotor and rotating with the rotation of the expander rotor and which generates power by the rotation of the power generator rotor; a bearing which is provided inside the casing and supports a rotation shaft of the expander rotor so that the expander rotor and the power generator rotor are rotatable about the axes thereof; a bearing holding portion which is provided inside the casing and accommodates the bearing therein while holding the bearing; and a lubricant supply path which connects a position for accumulating the lubricant separated by the separator in a space inside the casing to an inner space of the bearing holding portion accommodating the bearing, wherein the bearing holding portion is provided at a position in which a pressure of the inner space of the bearing holding portion becomes lower than a pressure of the position for accumulating the lubricant inside the casing.

In the power generation apparatus, the lubricant is separated from the fluid mixture flowing into the casing by the separator and the separated lubricant is accumulated in the casing. That is, since the lubricant may be separated inside the casing of the power generation apparatus, there is no need to separately provide the lubricant separation tank at the outside. For this reason, it is possible to realize a simple configuration and a compact size of the power generation apparatus and reduce the manufacturing cost thereof compared to the power generation apparatus of the related art with the lubricant separation tank. Further, in the power generation apparatus, since the lubricant accumulation position inside the casing may be connected to the inner space accommodating the bearing of the bearing holding portion by the lubricant supply path and the pressure of the inner space of the bearing holding portion is lower than the pressure of the lubricant accumulation position inside the casing, the lubricant which is separated by the separator inside the casing flows to the inner space of the bearing holding portion through the lubricant supply path so as to be supplied to the bearing by a difference in pressure between the lubricant accumulation position inside the casing and the inner space of the bearing holding portion. For this reason, there is no need to separately provide the pump that pressure-feeds the separated lubricant like the power generation apparatus of the related art. Even for this reason, in the power generation apparatus, the simple configuration and the compact size of the power generation apparatus may be realized and the manufacturing cost thereof may be reduced.

In the power generation apparatus, the casing may include an inlet through which the fluid mixture flows into the casing, and the separator may be formed by a separation member that is disposed to face the inlet so that the fluid mixture flowing into the casing through the inlet runs into the separation member.

In this configuration, the fluid mixture flowing into the casing through the inlet runs into the separation member and hence the lubricant falls downward in a flowing state by the own weight while the movement of the lubricant in the fluid mixture in the inflow direction is prohibited by the separation member. For this reason, it is possible to promote the separation of the lubricant in the fluid mixture flowing into the casing. Thus, according to this configuration, it is possible to specifically form the separator for separating the lubricant from the fluid mixture flowing into the casing.

In the configuration in which the separator is formed by the separation member, the separation member may include a demister which captures the lubricant in the fluid mixture flowing into the casing and running into the separation member.

Since the demister is formed in a mesh shape and exhibits a high capturing effect with respect to a droplet-shaped or mist-shaped liquid in an air stream, when the separation member includes the demister like this configuration, it is possible to satisfactorily capture the lubricant in the fluid mixture colliding with the demister of the separation member. For this reason, it is possible to improve the efficiency of separating the lubricant from the fluid mixture flowing into the casing.

In the configuration in which the separator is formed by the separation member, the separation member may include a facing surface which is disposed to face the inlet so that the fluid mixture flowing into the casing through the inlet runs into the facing surface, and the facing surface may be inclined with respect to the inflow direction of the fluid mixture flowing into the casing through the inlet.

In this configuration, since the facing surface of the separation member disposed to face the inlet of the casing is inclined with respect to the inflow direction of the fluid mixture, the fluid mixture flowing into the casing through the inlet runs into the facing surface of the separation member and forms the swirl flow while changing the direction along the inclination of the facing surface. As a result, the separation of the lubricant from the fluid mixture is promoted. For this reason, it is possible to improve the efficiency of separating the lubricant from the fluid mixture flowing into the casing.

In the power generation apparatus, a pair of the expander rotors may be provided inside the casing and an expansion chamber may be formed between the pair of expander rotors so that the steam of the working medium rotationally driving the expander rotor flows into the expansion chamber. Then, an upper portion inside the casing may be provided with a steam inlet that is used to introduce the steam of the working medium from which the lubricant is separated inside the casing into the expansion chamber.

In this configuration, since the steam inlet which is used to introduce the steam of the working medium into the expansion chamber is provided at the upper portion inside the casing, the lubricant which is separated by the separator inside the casing and falls in a flowing state may be prohibited from being mixed with the steam of the working medium which is separated from the lubricant and is supplied to the steam inlet.

The power generation apparatus may further include a lubricant discharge path that directly or indirectly connects the inner space of the bearing holding portion to a steam outlet through which the steam of the working medium is discharged from the expansion chamber.

Further, a power generation system according to the present invention is a power generation system with any of the power generation apparatuses, wherein the casing of the power generation apparatus may include an outlet through which the fluid mixture formed by mixing the steam of the working medium having been used to rotationally drive the expander rotor and the lubricant having been used to lubricate the bearing is discharged from the inside of the casing, and wherein the power generation system includes: a circulation flow passage which connects the outlet to the inlet; a condenser which is provided in the circulation flow passage and condenses the steam of the working medium in the fluid mixture discharged from the outlet so as to produce a liquid working medium; a circulation pump which is provided at a position on the downstream side of the condenser in the circulation flow passage and pressure-feeds the fluid mixture containing the liquid working medium produced by the condenser; and an evaporator which is provided at a position on the downstream side of the circulation pump in the circulation flow passage and evaporates the liquid working medium in the fluid mixture pressure-fed by the circulation pump so as to produce a fluid mixture containing the steam of the working medium supplied to the inlet.

In the power generation system, since the power generation apparatus is provided, it is possible to obtain the same effect as that of the power generation apparatus capable of realizing a simple configuration and a compact size thereof and reducing the manufacturing cost thereof.

In the power generation system, a weight ratio of the lubricant with respect to a total amount of the working medium and the lubricant introduced into the power generation system may be equal to or larger than 5 wt % and equal to or smaller than 20 wt %.

According to this configuration, it is possible to obtain the steam of the working medium by the amount enough to rotationally drive the expander rotor while ensuring the lubricant amount necessary for reliably supplying the lubricant to the bearing accommodated in the inner space of the bearing holding portion. Specifically, in this configuration, since the weight ratio of the lubricant with respect to the total amount of the working medium and the lubricant introduced into the power generation system is equal to or larger than 5 wt %, it is possible to ensure the lubricant amount in which the lubricant may be reliably supplied to the bearing. Meanwhile, in the evaporator, the steam of the working medium is produced by evaporating the liquid working medium in the fluid mixture, but in a case where the content of the lubricant in the fluid mixture is large and the content of the working medium therein is small, the transfer of heat to the liquid working medium in the fluid mixture is disturbed by the lubricant in the fluid mixture, so that a sufficient amount of the working medium may not be evaporated by the evaporator. On the contrary, when the weight ratio of the lubricant with respect to the total amount of the working medium and the lubricant introduced into the power generation system is equal to or smaller than 20 wt % as in the configuration, it is possible to produce the steam of the working medium by a sufficient amount necessary for rotationally driving the expander rotor even when the transfer of heat with respect to the working medium in the fluid mixture by the evaporator is slightly disturbed by the lubricant in the fluid mixture.

As described above, according to the present invention, it is possible to provide the power generation apparatus and the power generation system capable of realizing a simple configuration and a compact size thereof and reducing manufacturing cost thereof.

DESCRIPTION OF THE PREFERRED EMBODIMENTS

Figure 1:
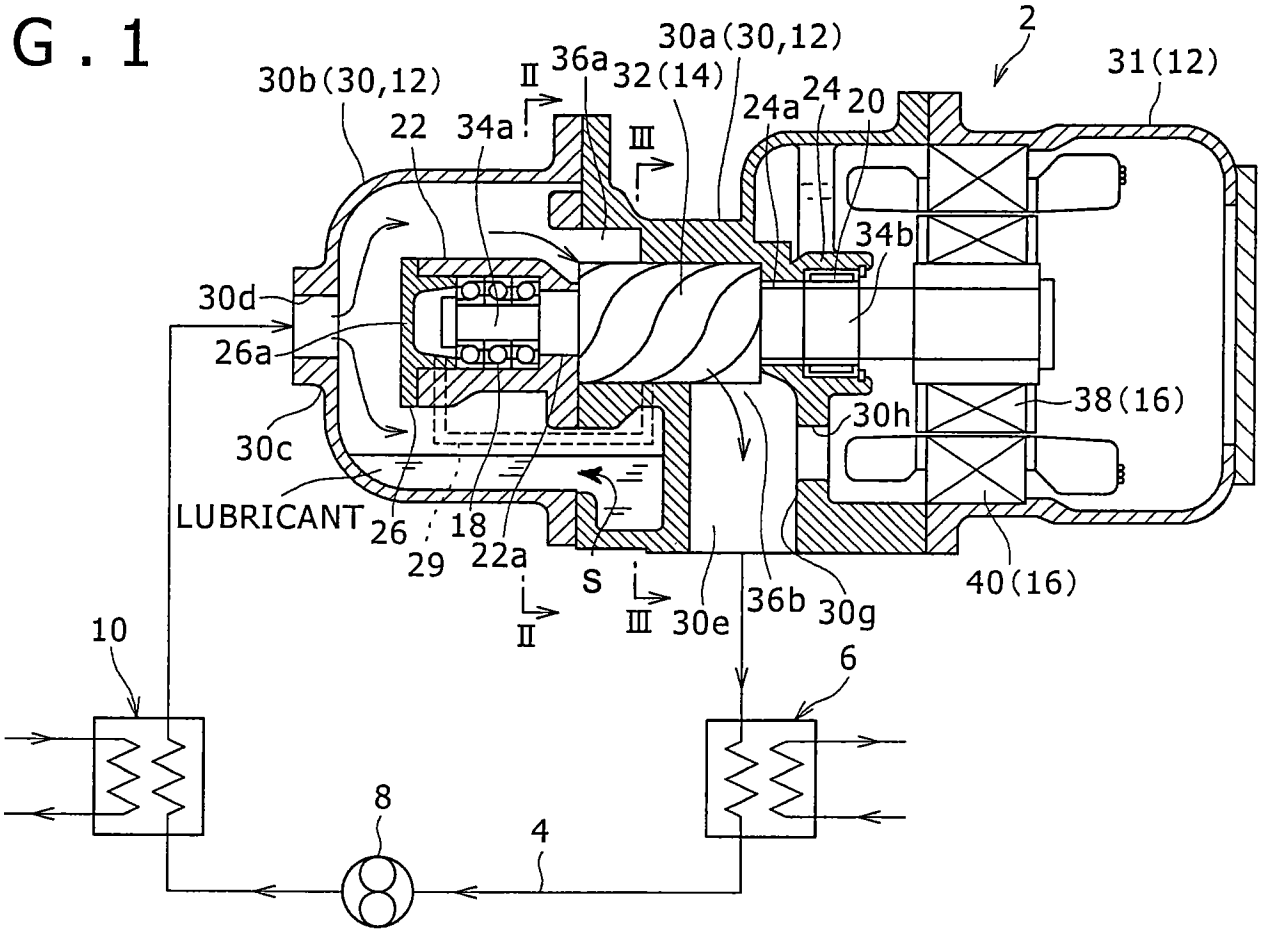
FIG. 1 is a schematic diagram illustrating an overall configuration of a power generation system according to a first embodiment of the present invention.

Hereinafter, exemplary embodiments of the present invention will be described by referring to the drawings.

First Embodiment

First, the configurations of a power generation apparatus 2 according to a first embodiment of the present invention and a power generation system using the same will be described by referring to FIGS. 1 to 4.

The power generation system according to the first embodiment is a power generation system that uses a Rankine cycle and is a binary-cycle power generation system that recovers power from low-temperature waste heat by using a working medium having a low boiling temperature. As the working medium, for example, a cooling medium such as R245fa (1,1,1,3,3-pentafluoropropane) is used.

Then, as illustrated in FIG. 1, the power generation system according to the first embodiment includes the power generation apparatus 2, a circulation flow passage 4, a condenser 6, a circulation pump 8, and an evaporator 10.

The power generation apparatus 2 is used to generate power by using the steam of the working medium supplied to the power generation apparatus 2. Although the power generation apparatus 2 will be described later, the power generation apparatus 2 includes a screw type expander 14 (hereinafter, simply referred to as an expander 14) and a power generator 16. Here, an expander rotor 32 to be described later of the expander 14 is rotationally driven by the expansion force of the steam of the working medium, and a power generator rotor 38 to be described later of the power generator 16 rotates with the rotation of the expander rotor 32 to thereby generate power. The steam of the working medium which is used to generate power in the power generation apparatus 2 is discharged from a fluid mixture outlet 30*e* to be described later to the circulation flow passage 4.

The circulation flow passage 4 causes an inlet 30*d* and the outlet 30*e* for a fluid mixture to be described later of the power generation apparatus 2 to be connected to each other (to communicate with each other). As will be described later, the lubricant and the steam of the working medium having been used to generate power are discharged from the fluid mixture outlet 30*e* of the power generation apparatus 2. The circulation flow passage 4 is a flow passage which circulates the fluid mixture so that the fluid mixture formed by mixing the steam of the working medium and the lubricant returns to the inlet 30*d*.

The condenser 6 is provided in the circulation flow passage 4. The condenser 6 condenses the steam of the working medium in the fluid mixture by cooling the fluid mixture discharged from the fluid mixture outlet 30*e* of the power generation apparatus 2 to the circulation flow passage 4 and flowing into the condenser 6. Accordingly, the steam is liquefied to produce a liquid working medium. The condenser 6 cools the fluid mixture by exchanging heat between the low-temperature cooling water and the fluid mixture. Since the steam of the working medium in the fluid mixture is liquefied, the fluid mixture discharged from the condenser 6 is obtained by mixing the liquid working medium with the liquid lubricant.

The circulation pump 8 is provided at a position on the downstream side of the condenser 6 in the circulation direction of the fluid mixture flowing through the circulation flow passage 4 in the circulation flow passage 4. The circulation pump 8 is used to pressure-feed the fluid mixture containing the liquid working medium produced by the condenser 6 to the downstream side.

The evaporator 10 is provided at a position on the downstream side of the circulation pump 8 in the working medium circulation direction of the circulation flow passage 4. The evaporator 10 is used to produce the steam of the working medium supplied to the inlet 30*d* of the power generation apparatus 2 by evaporating the liquid working medium in the fluid mixture pressure-fed by the circulation pump 8 using the waste heat. Specifically, a fluid such as hot water or steam, heated by the exhaust heat from a factory or the like to a temperature higher than the boiling temperature of the working medium, is supplied from the outside to the evaporator 10, and the fluid supplied from the outside exchanges heat with the fluid mixture inside the evaporator 10, so that the fluid mixture is heated and hence the liquid working medium in the fluid mixture is evaporated. Accordingly, the fluid mixture discharged from the evaporator 10 and supplied to the inlet 30*d* of the power generation apparatus 2 is obtained by mixing the steam of the working medium with the liquid lubricant.

With the above-described configuration, in the power generation system according to the first embodiment, a circulation circuit is formed in which the working medium is supplied from the evaporator 10 to the power generation apparatus 2 through the circulation flow passage 4, the working medium discharged from the power generation apparatus 2 to the circulation flow passage 4 is supplied to the condenser 6, and the working medium supplied to the condenser 6 returns to the evaporator 10 through the circulation pump 8. Then, when the working medium circulates in the circulation circuit, electric energy is generated from the waste heat. In the power generation system, the working medium and the lubricant are introduced thereinto as described above, but the weight ratio of the lubricant with respect to the total amount of the working medium and the lubricant introduced into the power generation system is set to be equal to or larger than 5 wt % and equal to or smaller than 20 wt %.

Next, the configuration of the power generation apparatus 2 in the power generation system according to the first embodiment will be described in detail.

The power generation apparatus 2 includes a casing 12, an expander 14, a power generator 16, plural first bearings 18, plural second bearings 20, a first bearing holding portion 22, a second bearing holding portion 24, a separation member 26, a lubricant supply path 28, and a lubricant discharge path 29.

The casing 12 forms the outer surface of the power generation apparatus 2, and is provided so as to extend in the horizontal direction. The casing 12 accommodates the expander 14 and the power generator 16 in the inner space thereof. Specifically, the casing 12 includes an expander casing 30 which accommodates the expander 14 therein and a power generator casing 31 which accommodates the power generator 16 therein. The expander casing 30 and the power generator casing 31 are fastened to each other so as to form the casing 12.

The expander casing 30 includes an expander casing body 30*a* which is fastened to the power generator casing 31 and accommodates the expander rotor 32 to be described later of the expander 14 therein and an expander casing lid portion 30*b* which is disposed on the opposite side to the power generator casing 31 with respect to the expander casing body 30*a* and is fastened to the expander casing body 30*a*.

The expander casing lid portion 30*b* is substantially formed in a bottomed cylindrical shape and is disposed so that the axial direction thereof matches the extension direction (the horizontal direction) of the casing 12. The expander casing lid portion 30*b* includes an end wall 30*c* which forms one end of the casing 12 in the extension direction, and the center portion of the end wall 30*c* is provided with the inlet 30*d* which extends in the axial direction of the expander casing lid portion 30*b* and penetrates the end wall 30*c*. The inlet 30*d* causes the fluid mixture formed by mixing the lubricant and the steam of the working medium to flow into the expander casing 30. Specifically, one end of the circulation flow passage 4 is connected to the inlet 30*d*. Then, as described above, the fluid mixture formed by mixing the liquid lubricant and the steam of the working medium produced by the evaporator 10 is supplied from the circulation flow passage 4 into the inlet, and the fluid mixture flows into the expander casing 30 through the inlet 30*d*.

The expander casing body 30*a* is provided with the fluid mixture outlet 30*e* which is opened downward. The fluid mixture outlet 30*e* is used to discharge the steam of the working medium having been used to rotationally drive the expander rotor 32 to be described later of the expander 14 and the lubricant having been supplied to the first bearing 18 and the second bearing 20 to lubricate the bearings 18 and 20 to the outside of the expander casing 30.

Specifically, the steam of the working medium discharged from the expansion chamber through a steam outlet 36*b* to be described later and the lubricant discharged to the steam outlet 36*b* from the lubricant discharge path 29 as will be described later are discharged from the fluid mixture outlet 30*e* to the outside. Further, a partition wall 30*g* is provided inside the expander casing body 30*a* so as to be located between the fluid mixture outlet 30*e* and the space near the power generator 16, and a communication port 30*h* is formed in the partition wall 30*g* so as to cause the inside of the fluid mixture outlet 30*e* to communicate with the space near the power generator 16. As will be described later, the lubricant having been used to lubricate the second bearing 20 flows to the space near the power generator 16 and flows in the fluid mixture outlet 30*e* through the communication port 30*h* so as to be discharged to the outside. The opposite end to the end connected to the inlet 30*d* in the circulation flow passage 4 is connected to the fluid mixture outlet 30*e*. Accordingly, the fluid mixture formed by mixing the liquid lubricant and the steam of the working medium is discharged from the inside of the expander casing 30 to the circulation flow passage 4 through the fluid mixture outlet 30*e*. Further, the lower portion of the expander casing body 30*a* is provided with a lubricant outlet 30*f* (see FIG. 3) which is used to discharge the lubricant accumulated in the lower space inside the expander casing 30. The lubricant outlet 30*f* is provided at a position near the inlet 30*d* of the fluid mixture outlet 30*e* in the expander casing body 30*a*, and communicates with the space S in which the lubricant is accumulated inside the expander casing 30.

The expander 14 includes a pair of expander rotors 32 (see FIG. 3) each of which rotates about its axis 32A in an engagement state. These expander rotors 32 are screw rotors. Each expander rotor 32 is provided with a first rotation shaft 34*a* which extends from the expander rotor 32 toward one side of the axial direction and a second rotation shaft 34*b* which extends from the expander rotor 32 to the other side of the axial direction. The first rotation shaft 34*a*, the second rotation shaft 34*b*, and the expander rotors 32 are formed so as to have the same axial position. The pair of expander rotors 32 is provided inside the expander casing 30, and is disposed so that the axial directions thereof match the extension direction of the casing 12 and the expander rotors are arranged in parallel in the right and left direction when viewed from the inlet 30*d*.

Each expander rotor 32 has spiral teeth formed along the outer peripheral surface thereof, and the teeth of the pair of expander rotors 32 engage with each other so that an expansion chamber 33 is formed therebetween. The upper portion of the space inside the expander casing body 30*a*, that is, the region located at the upper side of the pair of expander rotors 32 in the space inside the expander casing body 30*a* and located in the vicinity of the ends of both expander rotors 32 near the inlet 30*d* is provided with a steam inlet 36*a* which is used to introduce the steam of the working medium, into the expansion chamber. The steam inlet 36*a* communicates with the space inside the expander casing lid portion 30*b*. Further, the region located at the lower side of the pair of expander rotors 32 inside the expander casing body 30*a* and located from the vicinity of the ends opposite to (near the power generator 16) the inlet 30*d* in both expander rotors 32 to the intermediate portions of both expander rotors 32 in the axial direction is provided with a steam outlet 36*b* through which the steam of the working medium is discharged from the expansion chamber. The steam outlet 36*b* communicates with the fluid mixture outlet 30*e*. In the fluid mixture that flows into the expander casing 30 through the inlet 30*d*, the steam of the working medium passes through the steam inlet 36*a* so as to be introduced into the expansion chamber, and both expander rotors 32 are rotated about the axes thereof so as to expand the expansion chamber by the expansion force of the steam. In accordance with the rotation of both expander rotors 32, the expansion chamber moves toward the power generator 16, and communicates with the steam outlet 36*b* so as to discharge the steam of the working medium inside the expansion chamber to the fluid mixture outlet 30*e* through the steam outlet 36*b*.

The power generator 16 includes the power generator rotor 38 which is connected to one of the expander rotor 32 and a stator 40 which is disposed at the outside of the power generator rotor 38 in the rotation radial direction so as to surround the power generator rotor 38. The power generator rotor 38 is disposed so as to be coaxial with one expander rotor 32 and is connected to one expander rotor 32. Specifically, the power generator rotor 38 is connected to one expander rotor 32 through the second rotation shaft 34*b*. With this configuration, the power generator rotor 38 rotates along with the expander rotor 32 in accordance with the rotation of one expander rotor 32. Then, when the power generator rotor 38 rotates, power is generated between the power generator rotor 38 and the stator 40.

Figure 2:
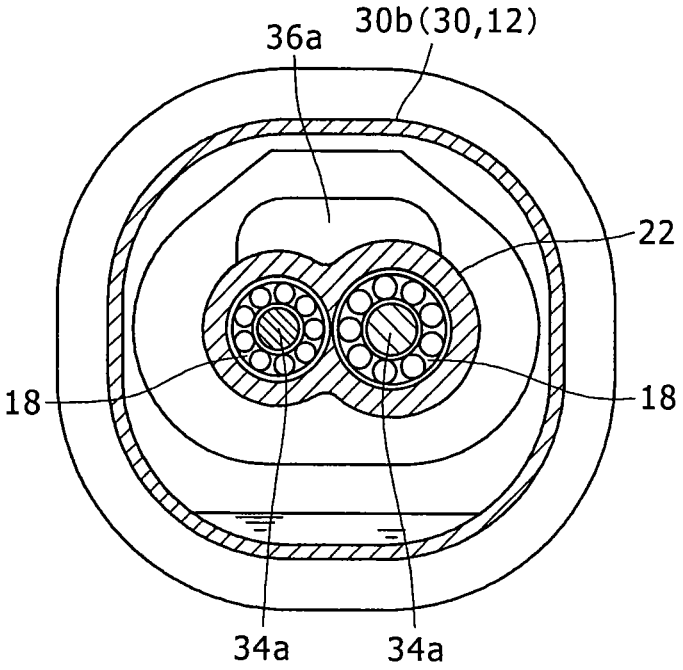
FIG. 2 is a cross-sectional view taken along the line II-II of FIG. 1 of a power generation apparatus of the power generation system according to the first embodiment.

Plural first bearings 18 are disposed in a space inside the expander casing lid portion 30*b*, and plural second bearings 20 are disposed in a space inside the expander casing body 30*a*. The first bearings 18 are used to axially support the first rotation shaft 34*a*, and the second bearings 20 are used to axially support the second rotation shaft 34*b*. Specifically, as illustrated in FIG. 2, in the plural first bearings 18, the first bearing 18 which axially supports the first rotation shaft 34*a* of one expander rotor 32 supports the first rotation shaft 34*a* so that one expander rotor 32 and the power generator rotor 38 are rotatable about the axes thereof. In the plural first bearings 18, the first bearing 18 which axially supports the first rotation shaft 34*a* of the other expander rotor 32 supports the first rotation shaft 34*a* so that the other expander rotor 32 is rotatable about the axis thereof. Further, in the plural second bearings 20, the second bearing 20 which axially supports the second rotation shaft 34*b* of one expander rotor 32 supports the second rotation shaft 34*b* so that one expander rotor 32 and the power generator rotor 38 are rotatable about the axes thereof. In the plural second bearings 20, the second bearing 20 which axially supports the second rotation shaft 34*b* of the other expander rotor 32 supports the second rotation shaft 34*b* so that the other expander rotor 32 is rotatable about the axis thereof.

The first bearing holding portion 22 accommodates the plural first bearings 18 therein so as to hold the first bearings 18. Specifically, the first bearing holding portion 22 is disposed in a space inside the expander casing lid portion 30*b*, and extends to the inside of the expander casing body 30*a* so as to be fastened and fixed to the portion facing the expander casing lid portion 30*b*. The first bearing holding portion 22 has an inner space 22A which accommodates the first bearing 18 supporting the first rotation shaft 34*a* of one expander rotor 32 and the first bearing 18 supporting the first rotation shaft 34*a* of the other expander rotor 32 while the first bearings are equally arranged and both ends thereof are opened. Into the inner space of the first bearing holding portion 22, the pair of first rotation shafts 34*a* of the pair of expander rotors 32 is inserted while being supported by the respectively corresponding first bearings 18.

The second bearing holding portion 24 accommodates the plural second bearings 20 therein and supports the second bearings 20. Specifically, the second bearing holding portion 24 is disposed in a space inside the expander casing body 30*a*, and is coupled to the expander casing body 30*a*. The second bearing holding portion 24 has an inner space 24A which accommodates the second bearing 20 supporting the second rotation shaft 34*b* of one expander rotor 32 and the second bearing 20 supporting the second rotation shaft 34*b* of the other expander rotor 32 while the second bearings are equally arranged and both ends thereof are opened. Into the inner space of the second bearing holding portion 24, the pair of second rotation shafts 34*b* of the pair of expander rotors 32 is inserted while being supported by the respectively corresponding second bearings 20. Further, in the inner space of the second bearing holding portion 24, a second shaft sealing chamber 24*a* is formed between the second bearing 20 and the end of the expander rotor 32 near the power generator 16. The second shaft sealing chamber 24*a* is provided so as to prevent the leakage of the steam from the expansion chamber to the power generator 16.

The separation member 26 is disposed in a space inside the expander casing lid portion 30*b*. The separation member 26 is used to separate the lubricant from the fluid mixture which flows into the expander casing 30 (into the expander casing lid portion 30*b*). Specifically, the separation member 26 is a plate-shaped member that is disposed to face the inlet 30*d* so that the fluid mixture flowing into the expander casing 30 through the inlet 30*d* runs into the plate-shaped member. The separation member 26 is attached to the end of the first bearing holding portion 22 near the inlet 30*d* so as to block the opening.

The separation member 26 includes a facing surface 26*a* which is disposed to face the inlet 30*d* so that the fluid mixture flowing into the expander casing 30 through the inlet 30*d* runs into the facing surface. The facing surface 26*a* is disposed so as to be perpendicular to the inflow direction of the steam of the fluid mixture flowing into the expander casing 30 through the inlet 30*d*, that is, the extension direction of the axis of the inlet 30*d*. The fluid mixture flowing into the expander casing 30 through the inlet 30*d* collides with the facing surface 26*a* of the separation member 26, and hence the lubricant in the fluid mixture falls along the facing surface 26*a* due to the own weight thereof. The lubricant which falls in a flowing state is accumulated in the lower space of the inner space in the expander casing 30. Further, the fluid mixture from which the lubricant is separated, that is, the steam of the working medium passes through the upper space of the first bearing holding portion 22 in the space inside the expander casing 30 (the expander casing lid portion 30*b*), flows to the steam inlet 36*a*, and is introduced into the expansion chamber from the steam inlet 36*a*.

The lubricant supply path 28 is used for the connection (communication) of the lower space in which the lubricant is accumulated in the space inside the expander casing 30, the inner space of the first bearing holding portion 22, and the second shaft sealing chamber 24*a* inside the second bearing holding portion 24. The lubricant supply path 28 is used to circulate the lubricant so that the lubricant accumulated in the lower space inside the expander casing 30 is supplied to the inner space of the first bearing holding portion 22 and the second shaft sealing chamber 24*a* inside the second bearing holding portion 24.

Figure 3:
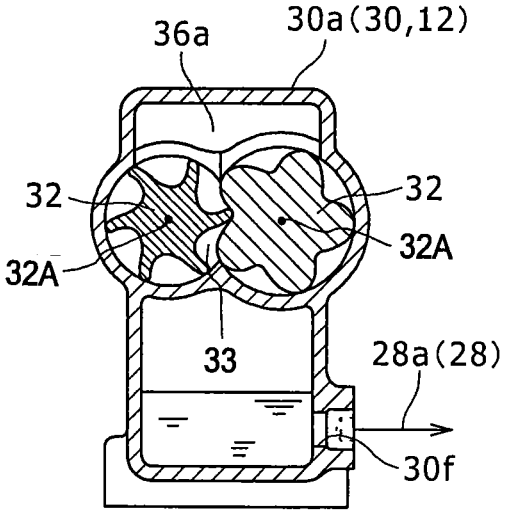
FIG. 3 is a cross-sectional view taken along the line III-III of FIG. 1 of the power generation apparatus of the power generation system according to the first embodiment.
Figure 4:
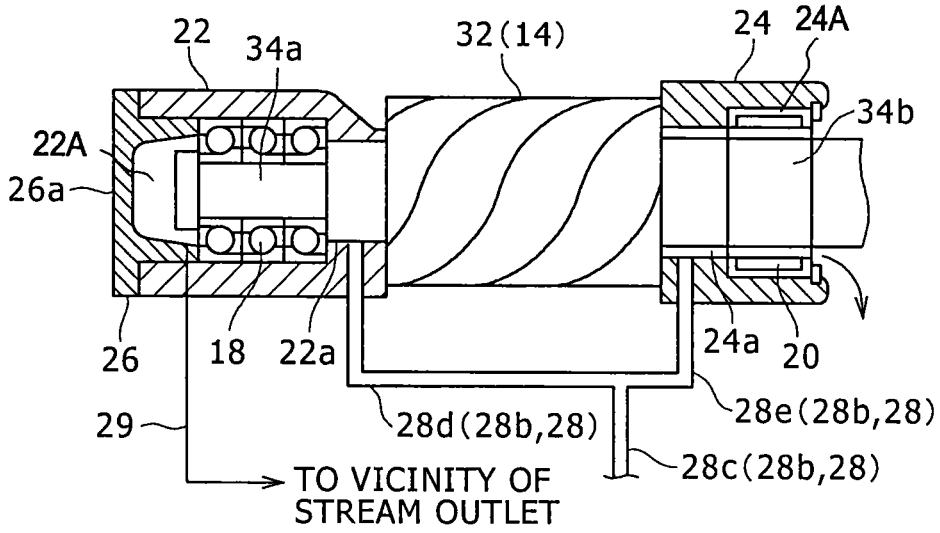
FIG. 4 is a schematic diagram illustrating a configuration of a lubricant supply path of the power generation apparatus of the power generation system according to the first embodiment.

Specifically, the lubricant supply path 28 includes an external pipe 28*a* illustrated in FIG. 3 and an inner flow passage 28*b* illustrated in FIG. 4.

The external pipe 28*a* is a pipe which is provided at the outside of the casing 12. One end of the external pipe 28*a* is connected to the lubricant outlet 30*f* provided in the expander casing body 30*a* and the other end of the external pipe 28*a* is connected to the inner flow passage 28*b*.

The inner flow passage 28*b* includes an introduction path 28*c* and a first supply path 28*d* and a second supply path 28*e* which are branched from the introduction path 28*c*. The other end of the external pipe 28*a* is connected to the opening end of the introduction path 28*c*. Furthermore, the introduction path 28*c* and a part of the first supply path 28*d* and the second supply path 28*e* may be provided inside the wall portion of the expander casing 30. The first supply path 28*d* is connected to a first shaft sealing chamber 22*a* adjacent to the first bearing 18 in the inner space of the first bearing holding portion 22. Further, the second supply path 28*e* is connected to the second shaft sealing chamber 24*a*.

The lubricant discharge path 29 is provided inside the expander casing 30 so as to cause the inner space of the first bearing holding portion 22 to be connected to (communicate with) the portion (specifically, the portion deviated to the first bearing holding portion 22 by one tooth in the expander rotor 32 in relation to the portion facing the steam outlet 36*b* in the expander rotor 32) near the steam outlet 36*b* in the expansion chamber. The lubricant discharge path 29 causes the lubricant to flow from the inner space of the first bearing holding portion 22 to the steam outlet 36*b*. Specifically, one end of the lubricant discharge path 29 is connected to a position opposite to the expander rotor 32 with respect to the portion accommodating the first bearing 18 in the inner space of the first bearing holding portion 22, and the other end of the lubricant discharge path 29 is connected to the expansion chamber near the steam outlet 36*b*. The lubricant discharge path 29 causes the lubricant, having been supplied to the first bearing 18 to lubricate the first bearing 18, to flow to the steam outlet 36*b*.

Further, the pressure of the inner space of the first bearing holding portion 22 and the pressure of the inner space of the second bearing holding portion 24 are set to be lower than the pressure of the lower space where the lubricant is accumulated inside the expander casing 30.

Specifically, since the lower space in which the lubricant is accumulated inside the expander casing 30 is a part of the inner space of the expander casing 30 into which the fluid mixture containing the steam of the working medium flows, the pressure of the space is equal to the pressure of the inner space of the expander casing 30 and is a comparatively high pressure.

Meanwhile, the first bearing holding portion 22 is set to a pressure close to the pressure inside the expansion chamber in the vicinity of the steam inlet 36*a*. Specifically, since the pressure inside the expansion chamber decreases as the steam of the working medium expands from the steam inlet 36*a* toward the steam outlet 36*b*, the pressure inside the expansion chamber in the vicinity of the steam inlet 36*a* is higher than the pressure inside the expansion chamber in the vicinity of the steam outlet 36*b*. However, since the inner space of the first bearing holding portion 22 is adjacent to the expansion chamber at the side of the steam inlet 36*a* and communicates with the steam outlet 36*b* through the lubricant discharge path 29, the pressure of the inner space of the first bearing holding portion 22 becomes an intermediate pressure between the pressure inside the expansion chamber in the vicinity of the steam inlet 36*a* and the pressure in the steam outlet 36*b* lower than the above-described pressure. Thus, the pressure of the inner space of the first bearing holding portion 22 becomes the pressure of the steam of the working medium introduced into the steam inlet 36*a*, that is, the pressure is lower than the pressure of the inner space of the expander casing 30. Furthermore, the pressure of the portion in the vicinity of the steam outlet 36*b* connected with the lubricant discharge path 29 is lower than the pressure of the inner space of the first bearing holding portion 22 and is slightly higher than the pressure of the steam outlet 36*b*.

Further, the pressure of the second bearing holding portion 24 becomes the pressure close to the pressure inside the expansion chamber in the vicinity of the steam outlet 36*b*. Specifically, since the inner space of the second bearing holding portion 24 is adjacent to the expansion chamber at the side of the steam outlet 36*b* and communicates with the fluid mixture outlet 30*e* through the space near the power generator 16 and the communication port 30*h*, the pressure of the inner space of the second bearing holding portion 24 becomes an intermediate pressure between the pressure inside the expansion chamber in the vicinity of the steam outlet 36*b* and the pressure of the fluid mixture outlet 30*e* lower than the above-described pressure. Thus, the pressure of the inner space of the second bearing holding portion 24 becomes the pressure of the steam of the working medium introduced into the steam inlet 36*a*, that is, the pressure fairly lower than the pressure of the inner space of the expander casing 30.

From the description above, each of the pressures of the inner spaces of the first and second bearing holding portions 22 and 24 becomes a pressure lower than the pressure of the lower space in which the lubricant is accumulated inside the expander casing 30, and a difference in pressure occurs between the lower space in which the lubricant is accumulated inside the expander casing 30 and the inner spaces of the first and second bearing holding portions 22 and 24. By the difference in pressure, the lubricant accumulated in the lower space inside the expander casing 30 is discharged through the lubricant outlet 30*f*, flows into the introduction path 28*c* of the inner flow passage 28*b* through the external pipe 28*a* of the lubricant supply path 28, passes from the introduction path 28*c* to the first supply path 28*d* so as to flow into the inner space of the first bearing holding portion 22, and also passes from the introduction path 28*c* to the second supply path 28*e* so as to flow into the second shaft sealing chamber 24*a* inside the second bearing holding portion 24. The lubricant which flows into the inner space of the first bearing holding portion 22 is supplied to the first bearing 18 while moving inside the inner space toward the side opposite to the expander rotor 32 by the difference in pressure inside the inner space and lubricates the first bearing 18. Further, the lubricant which flows into the second shaft sealing chamber 24*a* seals the periphery of the second rotation shaft 34*b* inside the second shaft sealing chamber 24*a* and suppresses the leakage of the steam of the working medium from the expansion chamber toward the power generator 16. Since the pressure of the power generator 16 is lower than that of the second shaft sealing chamber 24*a*, the lubricant is supplied from the second shaft sealing chamber 24*a* to the second bearing 20 so as to lubricate the second bearing 20.

Then, since the pressure inside the steam outlet 36*b* is lower than the pressure of the inner space of the first bearing holding portion 22, the lubricant having been used to lubricate the first bearing 18 passes from the inner space of the first bearing holding portion 22 to the lubricant discharge path 29 by the difference in pressure so as to be directed to the portion in the vicinity of the steam outlet 36*b* of the expansion chamber. At this time, since the pressure of the lubricant is slightly higher than the pressure of the steam outlet 36*b*, the driving of the expander rotor 32 is assisted. Accordingly, the power generation efficiency may be further improved. Then, the lubricant is discharged from the expansion chamber to the steam outlet 36*b* and is discharged from the steam outlet 36*b* to the fluid mixture outlet 30*e*. Further, since the pressure of the inner space of the power generator casing 31 is lower than the pressure of the inner space of the second bearing holding portion 24 and the pressure inside the fluid mixture outlet 30*e* is fairly lower than the pressure of the inner space of the power generator casing 31, the lubricant having been used to lubricate the second bearing 20 flows from the inner space of the second bearing holding portion 24 to the inner space of the power generator casing 31 and is discharged from the inner space of the power generator casing 31 to the fluid mixture outlet 30*e* through the communication port 30*h*. Then, the lubricant which is discharged to the fluid mixture outlet 30*e* forms the fluid mixture along with the steam of the working medium discharged from the expansion chamber to the fluid mixture outlet 30*e* through the steam outlet 36*b*, and is discharged to the circulation flow passage 4.

As described above, in the first embodiment, the lubricant is separated from the fluid mixture flowing into the expander casing 30 by the separation member 26 and the separated lubricant is accumulated in the lower space inside the expander casing 30. That is, in the first embodiment, since the lubricant may be separated inside the expander casing 30, there is no need to separately provide a lubricant separation tank at the outside. For this reason, in the first embodiment, the power generation apparatus 2 and the power generation system may have a simple configuration and a compact size and the manufacturing cost of the power generation apparatus 2 and the power generation system may be reduced compared to the power generation apparatus and the power generation system of the related art with the lubricant separation tank.

Further, in the first embodiment, as described above, the lubricant which is separated from the fluid mixture inside the expander casing 30 and is accumulated in the lower space inside the expander casing 30 automatically flows to the inner space of the first bearing holding portion 22 through the lubricant supply path 28 so as to be supplied to the first bearing 18 by a difference in pressure between the space and the inner space of the first bearing holding portion 22. Also, the lubricant automatically flows to the inner space of the second bearing holding portion 24 (the second shaft sealing chamber 24*a*) through the lubricant supply path 28 so as to be supplied to the second bearing 20 by a difference in pressure between the above-described space and the inner space of the second bearing holding portion 24. For this reason, in the power generation apparatus 2 and the power generation system according to the first embodiment, there is no need to separately provide the pump for pressure-feeding the separated lubricant as in the power generation apparatus and the power generation system of the related art. Even for this reason, in the first embodiment, the power generation apparatus 2 and the power generation system may have a simple configuration and a compact size and the manufacturing cost of the power generation apparatus 2 and the power generation system may be reduced.

Further, in the first embodiment, since the steam inlet 36*a* which introduces the steam of the working medium into the expansion chamber is provided at the upper portion inside the expander casing 30, it is possible to prohibit the lubricant separated by the separation member 26 and falling in a flowing state in the space inside the expander casing 30 from being mixed with the steam of the working medium separated from the lubricant and supplied to the steam inlet 36*a*.

Further, in the first embodiment, since the weight ratio of the lubricant with respect to the total amount of the lubricant and the working medium introduced into the power generation system is equal to or larger than 5 wt % and equal to or smaller than 20 wt %, it is possible to obtain the steam of the working medium by the amount enough to rotationally drive the expander rotor 32 while ensuring the lubricant amount necessary to reliably supply the lubricant to the first bearing 18 and the second bearing 20.

Specifically, in the first embodiment, since the weight ratio of the lubricant with respect to the total amount of the lubricant and the working medium introduced into the power generation system is equal to or larger than 5 wt %, it is possible to ensure the lubricant amount enough to reliably supply the lubricant to the first bearing 18 and the second bearing 20. Meanwhile, in the evaporator 10, the steam of the working medium is produced by evaporating the liquid working medium in the fluid mixture, but in a case where the content of the lubricant in the fluid mixture is large and the content of the working medium is small, the transfer of heat to the liquid working medium in the fluid mixture is disturbed by the lubricant in the fluid mixture, so that a sufficient amount of the working medium may not be evaporated by the evaporator 10. On the contrary, when the weight ratio of the lubricant with respect to the total amount of the lubricant and the working medium introduced into the power generation system is equal to or smaller than 20 wt % as in the first embodiment, it is possible to produce the steam of the working medium by a sufficient amount necessary to rotationally drive the expander rotor 32 even when the transfer of heat with respect to the working medium in the fluid mixture in the evaporator 10 is slightly disturbed by the lubricant in the fluid mixture. Furthermore, the weight ratio (equal to or larger than 5 wt % and equal to or smaller than 20 wt %) of the lubricant with respect to the total amount of the working medium and the lubricant is a value which is set by verifying the above-described effect in terms of the experiments repeated by the present inventor.

Second Embodiment

Figure 5:
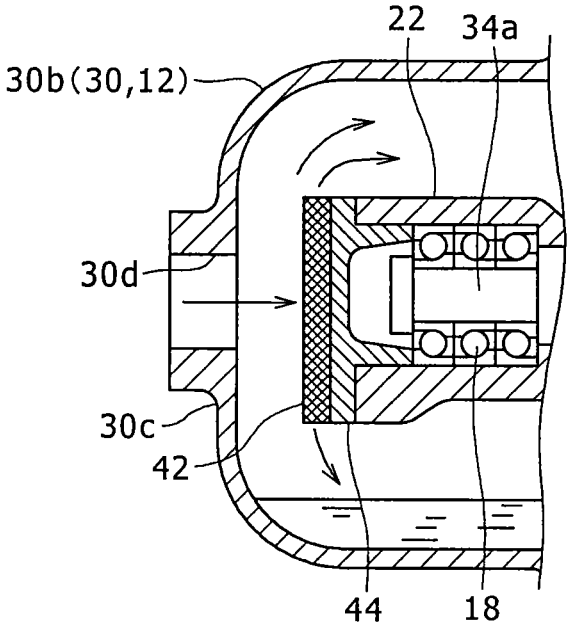
FIG. 5 is a longitudinal sectional view illustrating a structure of the vicinity of a fluid mixture inlet of a power generation apparatus of a power generation system according to a second embodiment of the present invention.

Next, referring to FIG. 5, the configurations of a power generation apparatus and a power generation system according to a second embodiment of the present invention will be described.

In the second embodiment, a separation member 42 provided inside the expander casing 30 is formed by a demister. Specifically, the demister is formed by overlapping plural mesh members such as metallic meshes, and has a function of capturing a mist-shaped liquid contained in the air stream. In the second embodiment, the separation member 42 that is formed by the demister is attached to a surface near the inlet 30*d* in an end plate 44 that blocks the opening of the end near the inlet 30*d* in the first bearing holding portion 22. Furthermore, the configuration of the end plate 44 is the same as the configuration of the separation member 26 of the first embodiment.

In the second embodiment, the fluid mixture flowing into the expander casing 30 through the inlet 30*d* runs into the separation member 42 formed by the demister, so that a droplet-shaped or a mist-shaped lubricant contained in the fluid mixture is captured by the separation member 42. Accordingly, the lubricant is separated from the fluid mixture flowing into the expander casing 30. The lubricant captured by the separation member 42 falls while flowing downward and is accumulated in the lower space inside the expander casing 30.

The configurations other than the above-described configurations of the power generation apparatus and the power generation system according to the second embodiment are the same as the configurations of the power generation apparatus 2 and the power generation system according to the first embodiment.

In the second embodiment, since the separation member 42 is formed by the demister, the lubricant in the fluid mixture flowing into the expander casing 30 and colliding with the separation member 42 may be satisfactorily captured by the separation member 42. For this reason, it is possible to improve the efficiency of separating the lubricant from the fluid mixture flowing into the expander casing 30.

The effects other than the above-described effect obtained by the power generation apparatus and the power generation system of the second embodiment are the same as those of the power generation apparatus 2 and the power generation system of the first embodiment.

Third Embodiment

Figure 6:
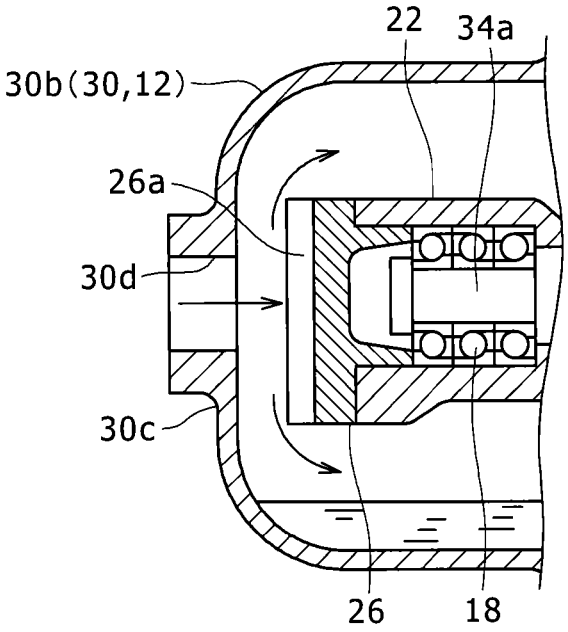
FIG. 6 is a longitudinal sectional view illustrating a structure of the vicinity of a fluid mixture inlet of a power generation apparatus of a power generation system according to a third embodiment of the present invention.
Figure 7:
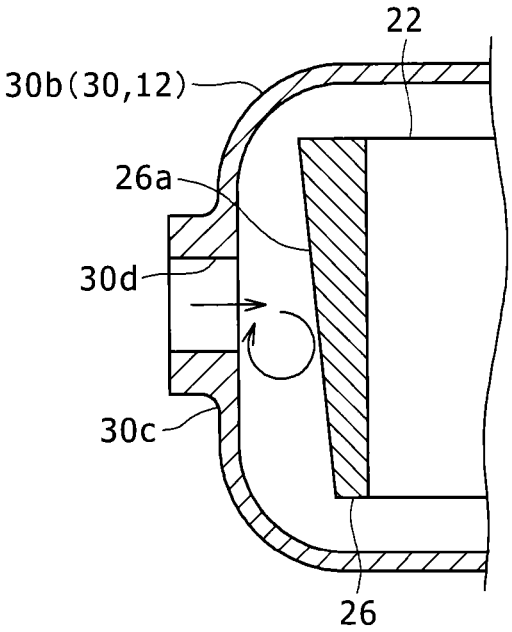
FIG. 7 is a transverse sectional view illustrating the vicinity of the inlet of the power generation apparatus according to the third embodiment illustrated in FIG. 6 (where a structure inside a first bearing holding portion is not illustrated)

Next, referring to FIGS. 6 and 7, the configurations of a power generation apparatus and a power generation system according to a third embodiment of the present invention will be described.

In the third embodiment, the separation member 26 provided inside the expander casing 30 is a plate-shaped member, and the facing surface 26*a* of the separation member 26 with respect to the inlet 30*d* is formed as an inclined surface which forms a swirl flow in the fluid mixture flowing into the expander casing 30.

Specifically, in the third embodiment, the separation member 26 is commonly used as the end plate that blocks the opening of the end near the inlet 30*d* in the first bearing holding portion 22 as in the case of the first embodiment. As illustrated in FIG. 7, the facing surface 26*a* which is disposed to face the inlet 30*d* in the separation member 26 is inclined in a direction moving away from the inlet 30*d* (toward the expander 14) as it goes from the left side to the right side in the facing surface 26*a*. With this configuration, the fluid mixture flowing into the expander casing 30 through the inlet 30*d* collides with the facing surface 26*a* of the separation member 26 and forms the swirl flow about the vertical axis while changing a direction along the inclination of the facing surface 26*a*.

The configurations other than the above-described configurations of the power generation apparatus and the power generation system according to the third embodiment are the same as the configurations of the power generation apparatus 2 and the power generation system according to the first embodiment.

In the third embodiment, since the fluid mixture flowing into the expander casing 30 forms the swirl flow as described above, the separation of the lubricant from the fluid mixture is promoted. For this reason, it is possible to improve the efficiency of separating the lubricant from the fluid mixture flowing into the expander casing 30.

The effects other than the above-described effect obtained by the power generation apparatus and the power generation system of the third embodiment are the same as those of the power generation apparatus 2 and the power generation system of the first embodiment.

Furthermore, it should be considered that the embodiments disclosed herein are merely examples and do not limit the present invention. The scope of the present invention is illustrated by the scope of claims instead of the description of the above-described embodiments and includes the meaning equivalent to the scope of claims and all modifications within the scope.

For example, in the second embodiment, the entire separation member 42 is formed by the demister, but only a part of the separation member may be formed by the demister.

Figure 8:
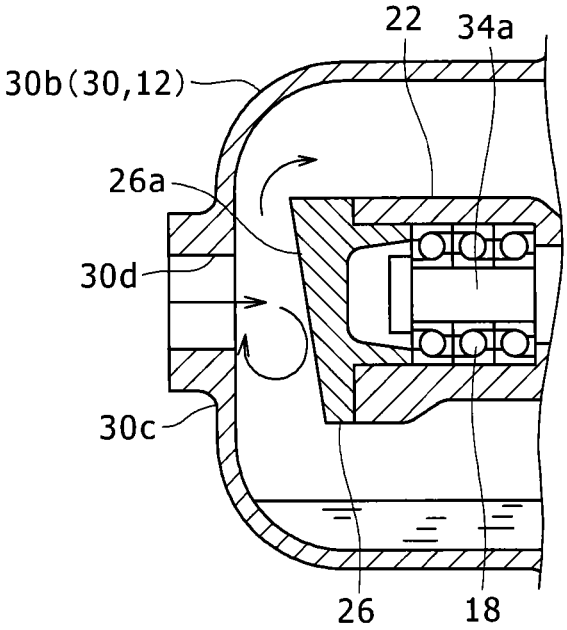
FIG. 8 is a longitudinal sectional view illustrating a structure of the vicinity of a fluid mixture inlet of a power generation apparatus according to a modified example of the third embodiment of the present invention.

Further, in the third embodiment, the facing surface 26*a* of the separation member 26 is inclined in a direction moving away from the inlet 30*d* as it goes from the left side to the right side in the facing surface 26*a*, but the inclination direction of the facing surface 26*a* of the separation member 26 is not limited to the direction. For example, as in a modified example of the third embodiment illustrated in FIG. 8, the facing surface 26*a* of the separation member 26 may be inclined in a direction moving away from the inlet 30*d* as it goes from the upside to the downside. According to the modified example, the fluid mixture flowing into the expander casing 30 through the inlet 30*d* collides with the facing surface 26*a* of the separation member 26 so that the direction is changed to the downside and the fluid mixture is guided to the lower space inside the expander casing 30. Accordingly, the lubricant in the fluid mixture guided to the lower space is accumulated in the lower space, and the steam of the working medium in the fluid mixture flows to the upper space of the first bearing holding portion 22 through both left and right spaces of the first bearing holding portion 22 inside the expander casing 30 so as to be supplied to the steam inlet 36*a*. Even in the configuration of the modified example, it is possible to improve the efficiency of separating the lubricant from the fluid mixture flowing into the expander casing 30. In the above-described embodiments, the lubricant discharge path 29 may be directly connected to the steam outlet 30*e*.

What is claimed is:

1. A power generation apparatus comprising:

a casing into which a fluid mixture formed by mixing a liquid lubricant and steam of a working medium flows;

a separator which is provided inside the casing so as to separate the lubricant from the fluid mixture flowing into the casing;

a pair of expander rotors which is provided inside the casing, wherein the rotors are rotationally driven by an expansion force applied from the steam of the working medium in the fluid mixture from which the lubricant is separated by the separator, wherein an expansion chamber is formed between the pair of expander rotors so that the steam of the working medium rotationally driving the expander rotors flows into the expansion chamber;

a power generator which includes a power generator rotor connected to the expander rotors and rotating with rotation of the expander rotors and which generates power by the rotation of the power generator rotor;

a bearing which is provided inside the casing and supports a rotation shaft of the expander rotors so that the expander rotors and the power generator rotor are rotatable about axes thereof;

a bearing holding portion which is provided inside the casing and accommodates the bearing therein while holding the bearing;

a lubricant supply path which connects a position for accumulating the lubricant separated by the separator in a space inside the casing to an inner space of the bearing holding portion accommodating the bearing; and a lubricant discharge path that directly or indirectly connects the inner space of the bearing holding portion to a steam outlet through which the steam of the working medium is discharged from the expansion chamber, wherein the bearing holding portion is provided at a position in which a pressure of the inner space of the bearing holding portion is lower than a pressure of the position for accumulating the lubricant inside the casing, wherein the casing includes an inlet through which the fluid mixture flows into the casing, and wherein the separator is formed by a separation member that is disposed to face the inlet so that the fluid mixture flowing into the casing through the inlet runs into the separation member, and wherein the separation member comprises an inclined surface inducing the fluid mixture flowing into the casing to form a swirl flow to promote separation of the lubricant from the fluid mixture.

2. The power generation apparatus according to claim 1, wherein the separation member includes a demister which captures the lubricant in the fluid mixture flowing into the casing and running into the separation member.

3. The power generation apparatus according to claim 1, wherein an upper portion inside the casing is provided with a steam inlet that is used to introduce the steam of the working medium from which the lubricant is separated inside the casing into the expansion chamber.

4. A power generation system with the power generation apparatus according to claim 1, wherein the casing of the power generation apparatus includes an outlet through which the fluid mixture formed by mixing the steam of the working medium having been used to rotationally drive the expander rotors and the lubricant having been used to lubricate the bearing is discharged from an inside of the casing, and wherein the power generation system comprises:

a circulation flow passage which connects the outlet to the inlet of the casing;

a condenser which is provided in the circulation flow passage and condenses the steam of the working medium in the fluid mixture discharged from the outlet so as to produce a liquid working medium;

a circulation pump which is provided at a position on a downstream side of the condenser in the circulation flow passage and pressure-feeds a fluid mixture containing the liquid working medium produced by the condenser; and an evaporator which is provided at a position on a downstream side of the circulation pump in the circulation flow passage and evaporates the liquid working medium in the fluid mixture pressure-fed by the circulation pump so as to produce a fluid mixture containing the steam of the working medium supplied to the inlet.

5. The power generation system according to claim 4, wherein a weight ratio of the lubricant with respect to a total amount of the working medium and the lubricant introduced into the power generation system is equal to or larger than 5 percent by weight and equal to or smaller than 20 percent by weight.

6. The power generation apparatus according to claim 1, wherein the lubricant discharge path comprises a conduit having one end in the bearing holding portion and another end connected to the expansion chamber adjacent the steam outlet.

* * * * *